US008210139B2

(12) United States Patent
Meisel

(10) Patent No.: US 8,210,139 B2
(45) Date of Patent: Jul. 3, 2012

(54) ENGINE ELECTRONIC VALVE ACTUATION

(76) Inventor: David Meisel, Clawson, MI (US)

( * ) Notice: Subject to any disclaimer, the term of this patent is extended or adjusted under 35 U.S.C. 154(b) by 323 days.

(21) Appl. No.: 12/509,720

(22) Filed: Jul. 27, 2009

(65) Prior Publication Data

US 2010/0024749 A1 Feb. 4, 2010

Related U.S. Application Data

(60) Provisional application No. 61/085,671, filed on Aug. 1, 2008.

(51) Int. Cl.
*F01L 9/04* (2006.01)

(52) U.S. Cl. ..... 123/90.11; 123/90.15; 251/129.15; 251/129.16

(58) Field of Classification Search ..... 123/90.15, 123/90.16, 90.11; 251/129.15, 129.16
See application file for complete search history.

(56) References Cited

U.S. PATENT DOCUMENTS

| | | | | |
|---|---|---|---|---|
| 3,882,833 | A | 5/1975 | Longstaff et al. | |
| 3,956,724 | A | 5/1976 | Fagan, Jr. | |
| 4,692,560 | A | 9/1987 | Hotta et al. | |
| 4,808,954 | A | 2/1989 | Ito | |
| 4,861,149 | A | 8/1989 | Ealey | |
| 5,936,502 | A | 8/1999 | Englund et al. | |
| 6,318,312 | B1 * | 11/2001 | Bauer et al. | 123/90.11 |
| 6,354,253 | B1 | 3/2002 | Katsumata et al. | |
| 6,972,655 | B2 | 12/2005 | Tobias | |
| 2002/0117132 | A1 * | 8/2002 | D'Alpaos et al. | 123/90.11 |

FOREIGN PATENT DOCUMENTS

| | | | |
|---|---|---|---|
| DE | 19714496 | A1 | 10/1998 |
| JP | 2006144713 | A * | 6/2006 |

OTHER PUBLICATIONS

Abstract of JP 2006144713 A listed above; Jun. 2006.*

* cited by examiner

*Primary Examiner* — Zelalem Eshete
(74) *Attorney, Agent, or Firm* — Gifford, Krass, Sprinkle, Anderson & Citkowski, P.C.; Douglas L. Wathen

(57) ABSTRACT

A head assembly for an internal combustion engine includes an electromagnetic valve actuation system. The head has an intake or exhaust passage defined therein. A valve is disposed in the passage and is operable to selectively open and close the passage. The head has a cooling passage defined therein for passage of a cooling fluid. An electromagnetic actuator has a piston in mechanical communication with the valve and a coil in fluid communication with the cooling passage. The electromagnetic actuator is operable to move the valve between a closed and an open position.

5 Claims, 7 Drawing Sheets

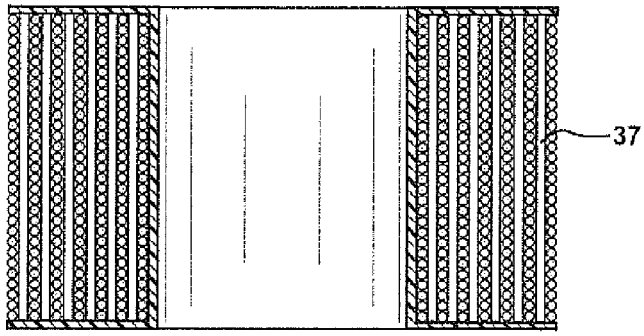
FIG. 2
FIG. 3
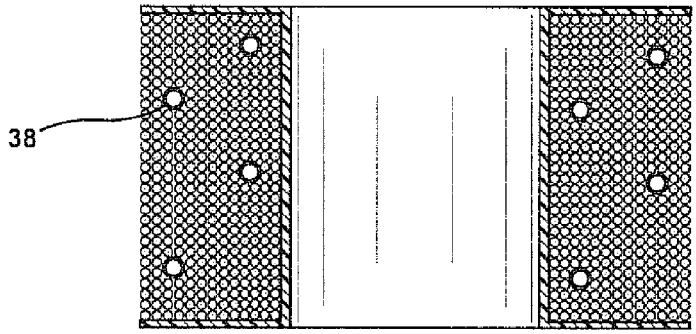
FIG. 4
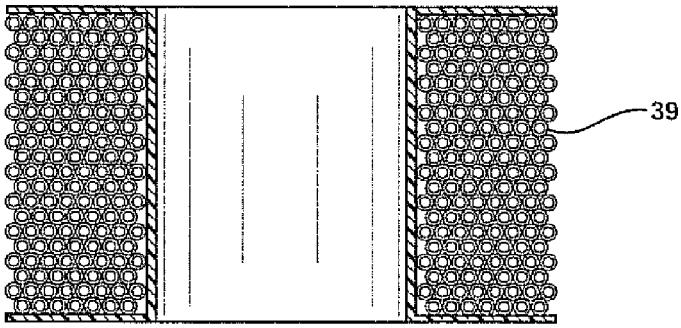

ENGINE ELECTRONIC VALVE ACTUATION

CROSS REFERENCE TO RELATED APPLICATIONS

This application claims priority from U.S. provisional Patent Application Ser. No. 61/085,671, filed Aug. 1, 2008, the entire content of which is incorporated herein by reference.

FIELD OF THE INVENTION

The present invention relates generally to valve systems and, more specifically, to an electronic valve actuation system for use in applications such as internal combustion engines and other applications.

BACKGROUND OF THE INVENTION

There have been numerous attempts to provide electronic valve actuation systems for internal combustion engines. Such systems would overcome the inherent limitations presented by traditional cam actuation systems. They would allow independent control of valve actuation, completely variable valve actuation timing and duration and other benefits. However, current attempts to provide electronic valve actuations for systems such as these are generally unsuccessful because solenoid actuators used in such systems are not capable of sustained output force levels sufficient to be useful in internal combustion engine applications.

SUMMARY OF THE INVENTION

The present invention provides several embodiments of improved actuation systems and methods. According to a first embodiment of the present invention, a head assembly for an internal combustion engine includes an electromagnetic valve actuation system. A head has an intake or exhaust passage defined therein. A valve is disposed in the passage and is operable to selectively open and close the passage. The head has a cooling passage defined therein for passage of a cooling fluid. An electromagnetic actuator has a piston in mechanical communication with the valve and a coil in fluid communication with the cooling passage. The electromagnetic actuator is operable to move the valve between a closed and an open position.

In some embodiments, the head is at least partially formed of a ferromagnetic material, and the coil of the electromagnetic actuator is disposed in the head such that the coil is at least partially surrounded by the ferromagnetic material and the ferromagnetic material forms a flux path for the coil.

In some embodiments, the coil includes a coil support and a coil wire wound around the coil support. The head assembly is configured such that no ferromagnetic material is disposed between the coil wire and the ferromagnetic material of the head. The coil wire may be disposed in direct contact with the cooling fluid from the cooling passage. The coil may further include spacers for providing space in the coil wire winding, or may include cooling tubes disposed in the coil wire winding, or the coil wire may be a hollow tube.

The present invention also provides a method of operating an intake valve. An electromagnetic actuation system includes a head having an intake or exhaust passage defined therein. A valve is disposed in the passage and operable to selectively open and close the passage. The head has a cooling passage defined therein for passage of a cooling fluid. An electromagnetic actuator has a piston in mechanical communication with the valve and a coil in fluid communication with the cooling passage. The electromagnetic actuator is operable to move the valve between a closed and an open position. The method includes defining an intake period during which an intake mixture may be provided to a combustion cylinder and using the electromagnetic actuator to open and close the valve multiple times during the intake period.

BRIEF DESCRIPTION OF THE DRAWINGS

FIG. 2 is a detailed cross sectional view of a coil for use with the present invention;

FIG. 3 is a detailed cross sectional view of another coil for use with the present invention;

FIG. 4 is a detailed cross sectional view of a further coil for use with the present invention;

DETAILED DESCRIPTION OF THE PREFERRED EMBODIMENTS

The present invention provides an improved electronic valve actuation system for use in a variety of applications. Preferred embodiments of the present invention make use of one or more of the following features. First, some embodiments make use of the ferromagnetic material found in the surrounding cylinder head or other assembly as part of the flux path for a solenoid coil. This improved flux path improves the efficiency and/or the force levels obtained from the solenoid coil. Secondly, some embodiments of the present invention make use of a larger coil diameter than traditionally used in a similar application. This is partially made possible by the fact that the coil is making use of the surrounding ferromagnetic material as part of the flux path and does not make use of traditional outer housings for the coil itself. This provides more room for the coil. Thirdly, in preferred embodiments of the present invention, part of or the entire solenoid coil is placed in or in contact with a liquid cooling medium, most preferably the liquid cooling system already present in a system such as a cylinder head for an internal combustion engine. This dramatically increases the removal of heat from the solenoid coil, thereby dramatically increasing the ability of the solenoid coil to output high force levels for an extended period of time. Fourth, some embodiments of the present invention determine the position of the solenoid piston by measuring the reactive voltage or current rise time in the solenoid coil, as will be discussed further hereinbelow. This allows a determination of the solenoid piston position without the addition of sensors or secondary sensing apparatus. Fifth, some embodiments of the present invention make use of an alternative valve actuation profile made possible by the use of electronic actuation. According to this profile, a valve is opened a short distance multiple times within an interval during which a valve would normally go through a single opening and closing interval. This "pulsed" valve actuation profile may be used during certain operating conditions and may provide increased amounts of air to fill the combustion chamber due to the inertial characteristics of the pulsed flow. At the same time, this profile decreases the power requirements of the electronic valve actuation system.

Figure 1:
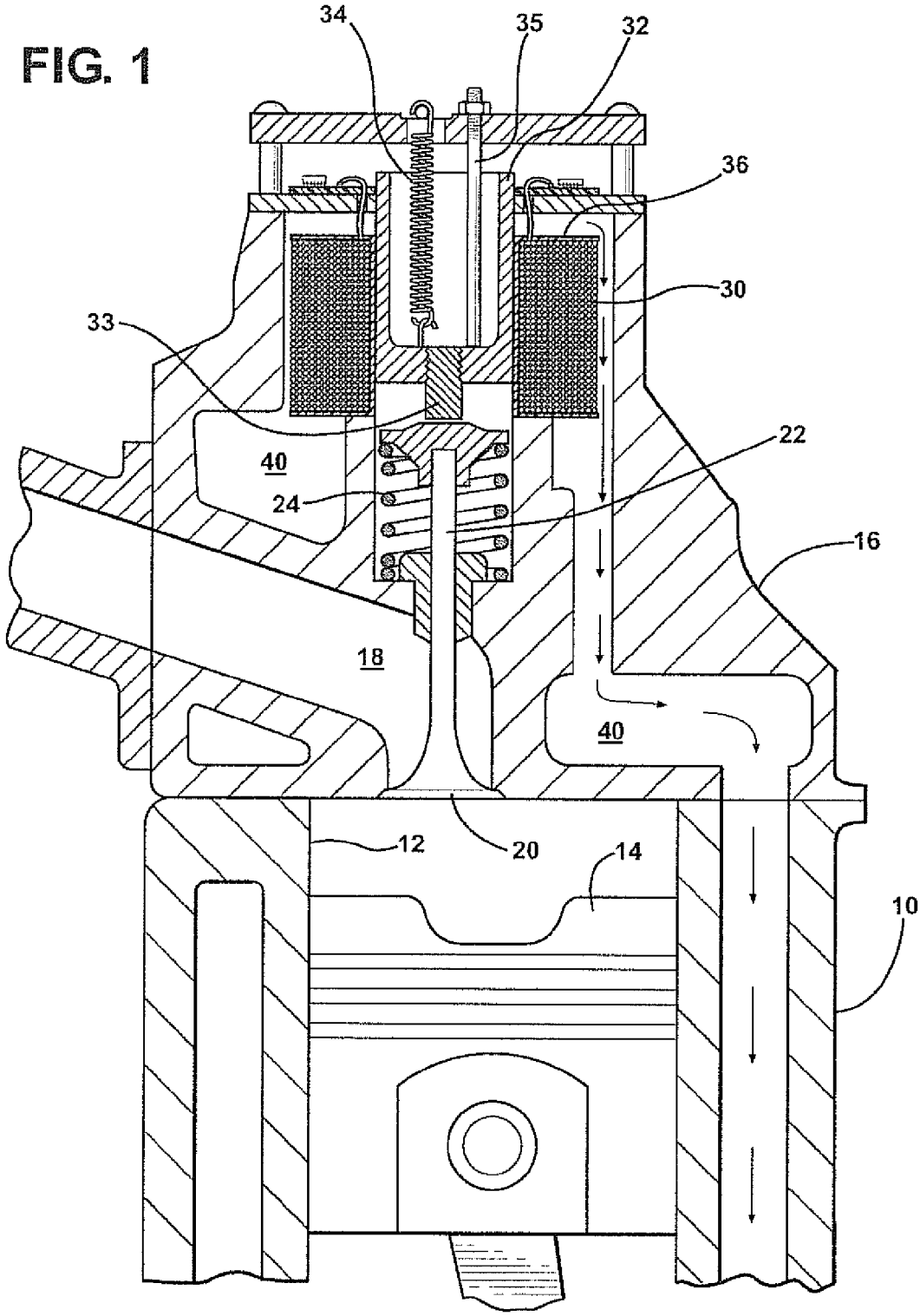
FIG. 1 is a cross sectional view of a portion of an engine illustrating an embodiment of the present invention.

Referring now to FIG. 1, a cross-sectional view of a portion of an internal combustion engine is provided to illustrate various aspects of some of the preferred embodiments of the present invention. FIG. 1 shows a portion of an engine block 10 with a cylinder 12 defined in the block and a piston 14 received in the cylinder so as to define a combustion chamber between the upper end of the piston 14 and the head 16. An intake or exhaust port 18 is defined in the head 16. The intake or exhaust port 18 is selectively opened and closed by a valve 20 so as to allow an intake mixture to flow into the combustion chamber or the exhaust gases to flow out of the combustion chamber. As known to those of skill in the art, modern internal combustion engines may have multiple intake and multiple exhaust valves arranged in various ways so as to improve flow into and out of the combustion chamber. FIG. 1 is merely a simplified representation of a single valve and the various aspects of the present invention described herein may be applied to other engine and valve designs. As one example, the present invention may be applied to a monoblock design in which the head and block are integral.

Traditionally, a valve such as valve 20 is opened by a cam lobe or rocker arm pressing on an upper end of the valve stem 22 and a valve spring, such as spring 24, holds the valve closed when the cam lobe or rocker arm is not pressing on the valve stem 22. In the illustrated embodiment, the head 16 is formed of cast iron and a solenoid coil 30 is disposed in the head 16. It will be appreciated that the coil is typically generally cylindrical with a central bore. In the illustrated embodiment, this bore is aligned with the valve stem 22, and in some embodiments the stem may extend through the bore such that the coil 30 surrounds the valve stem 22. A solenoid piston 32 is disposed in the bore of the coil 30 and mechanically communicates with the valve stem 22. In the illustrated embodiment, the piston has a lower end 33 that takes the form of a lash adjusting element. Alternatively, the piston may be connected to or form part of the valve stem 22 such that the valve stem and piston move together. As known to those of skill in the art, when the solenoid coil 30 is energized, an electromagnetic force is applied to the piston 32. In the illustrated embodiment, this causes the piston 32 to move downwardly thereby causing the lash adjusting element to contact the top of the valve assembly. When the force exerted by the piston 32 exceeds the spring force in spring 24, the valve 20 is moved downwardly, thereby allowing the intake or exhaust port to communicate with the combustion chamber.

In the illustrated embodiment, the piston 32 is urged into its upward retracted position by a retention spring 34. A travel limiter 35 adjusts the position of the piston. The retention spring and travel limiter may tale a variety of forms other than those illustrated.

The head 16 is preferably at least partially made of a ferromagnetic material, such as cast iron. In the illustrated embodiment, the solenoid coil 30 is disposed in the head such that it is at least partially surrounded by the ferromagnetic material of the head. The coil 30 can make use of the surrounding ferromagnetic material as a portion of the flux path. As known to those of skill in the art, a solenoid coil typically has an outer housing that encloses the bobbin and winding. The housing may be made of a ferromagnetic material, but is typically thin and has low mass. In preferred embodiments of the present invention, this outer housing is eliminated or is made out of a non-ferromagnetic material such that the flux path becomes the surrounding ferromagnetic material. In one approach, the housing is a stainless steel cage with openings therein. By way of definition, the actuation system may be described as having a coil of wire supported on a coil support 36 and as not having any ferromagnetic material between the coil and the surrounding structure. The surrounding structure should have enough ferromagnetic material above, to the side, and below the coil to provide a complete flux path. Preferably, there is at least a 0.2 inch thickness of ferromagnetic material above and below the coil and 0.1 inch thickness to the sides, all in electromagnetic communication with each other. In the illustrated embodiment, the coil support 36 takes the form of a bobbin that defines the bore of the coil and has the coil wire wound around it.

As also shown in FIG. 1, a portion of the solenoid coil 30 is disposed in the cooling passages 40 in the head 16. This causes engine coolant to flow in and around the coil wires and to remove heat from the solenoid coil 30. This dramatically increases the cooling efficiency and the sustained force levels that can be obtained with the solenoid coil. As also shown, because the solenoid coil 30 is not in its own housing, such as an enclosed plastic or metal housing, and because the coil extends into the cooling passages, there is substantially more room for the coil allowing the use of a larger coil.

Several alternative approaches may be used to cool the coil with the liquid. In the simplest approach, the coil or wire is formed in a traditional way, with each wire having an insulating coating, and the liquid flows over the coil. To enhance the cooling, the insulation on the wires may be perforated or an insulation with enhanced heat transfer characteristics may be used. As another approach, the wire may be provided in layers with spacers 37 therebetween, as shown in FIG. 2, to allow increased flow. The spacer layers may take a variety of forms, such as a mesh, open grids, or perforated plastic. If the spacers electrically insulate the wire layers from adjacent layers, the wire may be bare or partially bare in this approach. The wire layers may be separate windings that are connected in series or parallel or may be a continuous winding. As yet another approach, cooling passages may be defined through the coil, such as by adding spacers or tubes 38 as shown in FIG. 3, or other approaches. As a further alternative, the coil may be formed using hollow tubing 39 as the wire, as shown in FIG. 4, and liquid may be passed through the tubing. Preferably such tubing is small and thin walled. Winding such tubing may require filling it with liquid to avoid crushing.

Figure 5:
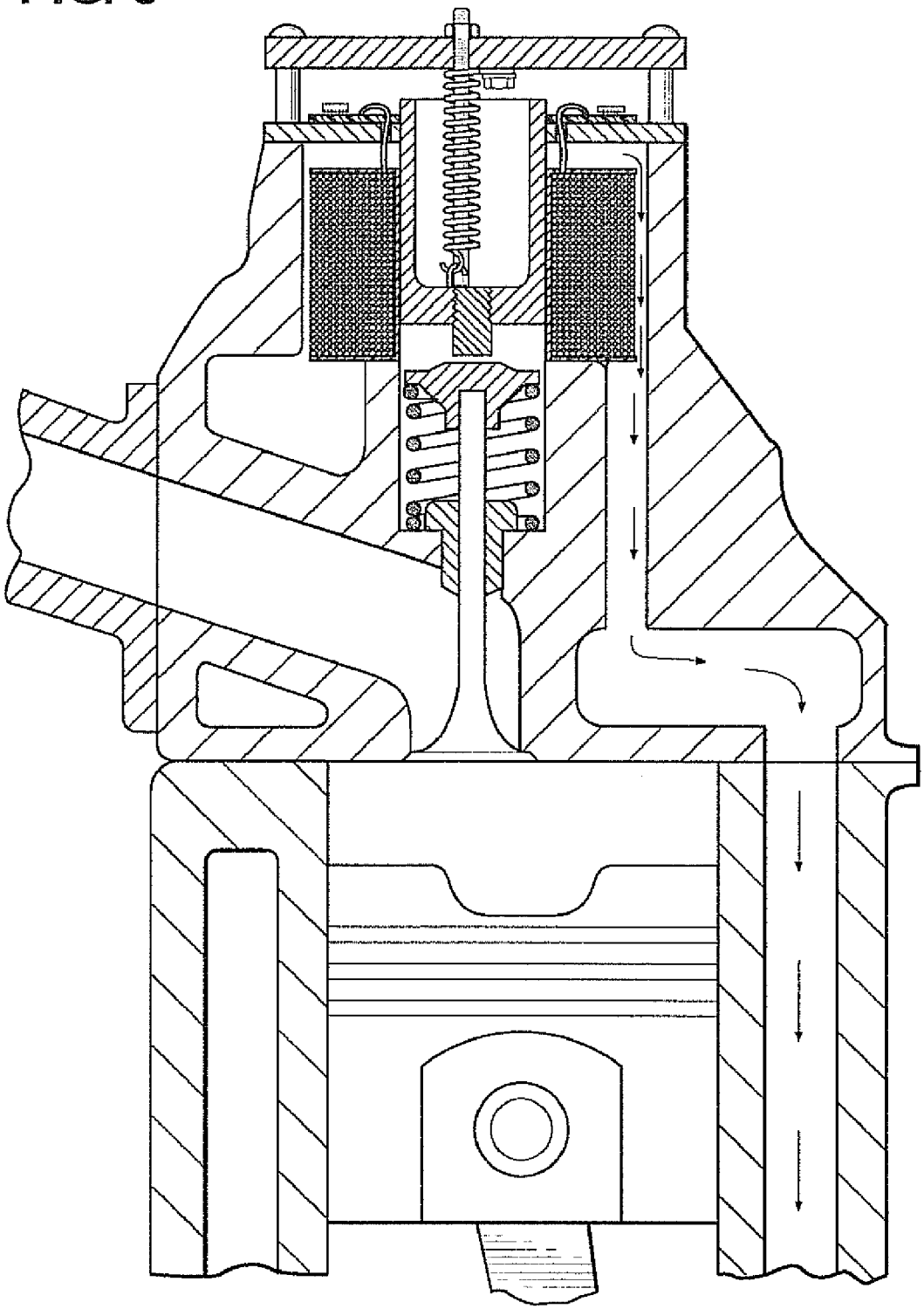
FIG. 5 is a cross sectional view of a portion of an engine illustrating an alternative embodiment of the present invention.
Figure 6:
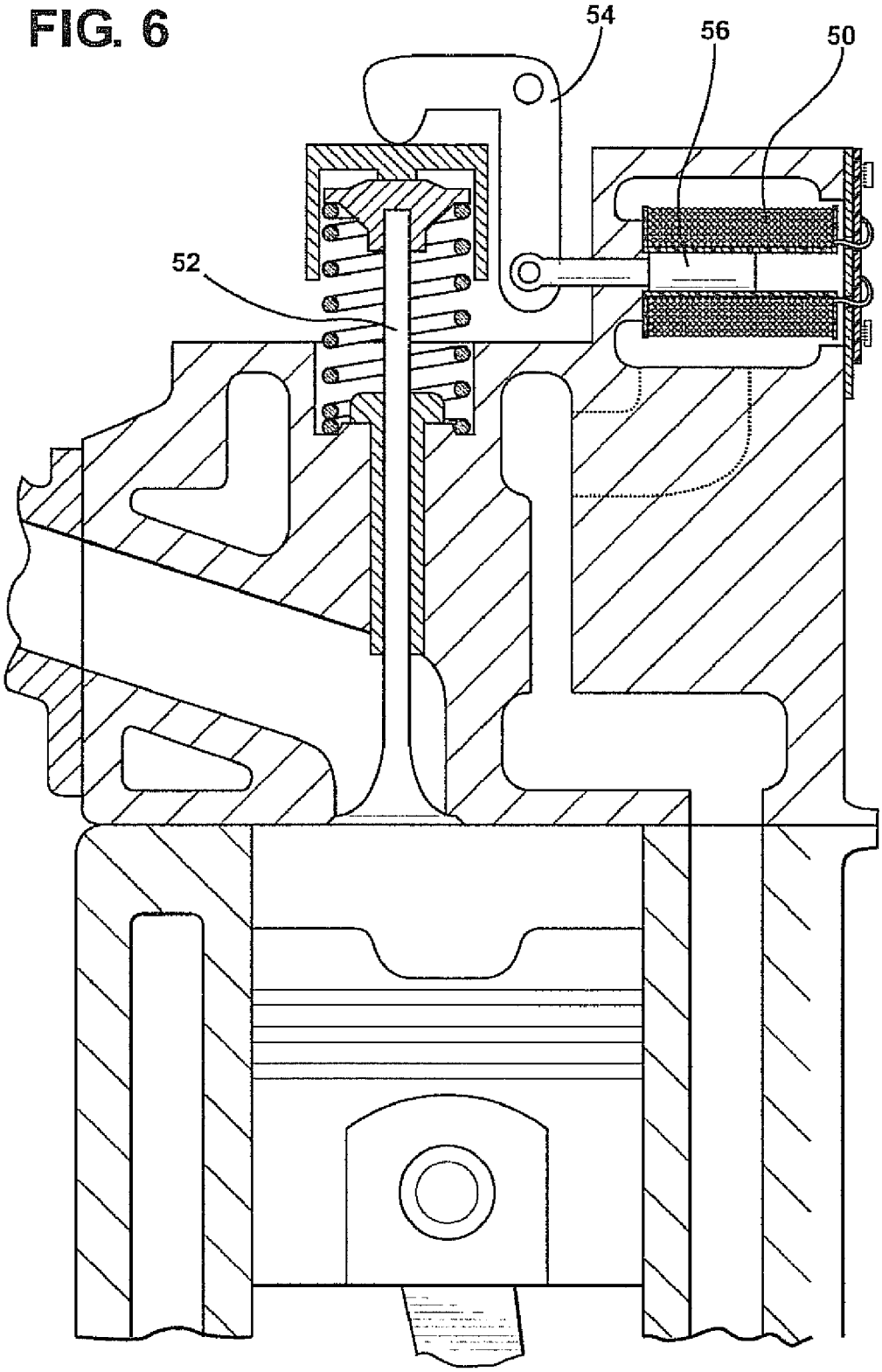
FIG. 6 is a cross sectional view of a portion of an engine illustrating another alternative embodiment of the present invention.
Figure 7:
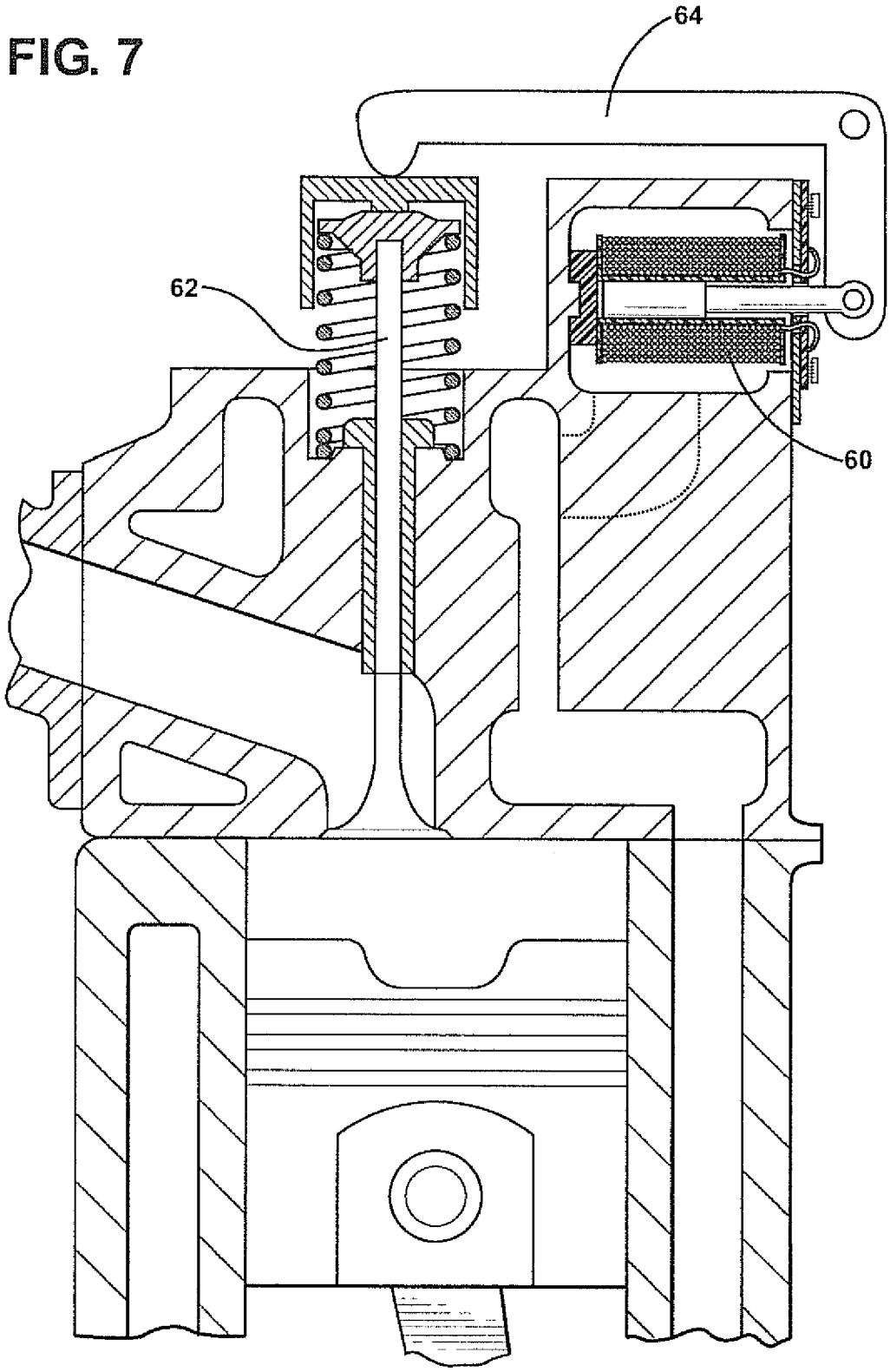
FIG. 7 is a cross sectional view of a portion of an engine illustrating yet another alternative embodiment of the present invention.

Referring now to FIG. 5, an alternative assembly is provided using an integrated retention spring and travel limiter. FIG. 6 illustrates an alternative embodiment in which the actuator 50 is disposed to the side of the valve 52 and is in mechanical communication with the valve 52 via a rocker arm 54. The piston 56 "pulls" in order to open the valve. FIG. 7 illustrates a further alternative in which the actuator 60 is to the side and pushes on a rocker arm 64 in order to open valve 62. These alternatives are illustrated schematically, but those of skill in the art will recognize that these arrangements may provide packaging benefits. Also, a rocker arm may be used to adjust the mechanical advantage of the actuators relative to the valves. Preferably, these embodiments also have the coils disposed in the head so that the ferromagnetic material of the head forms a flux path, and the coils are in fluid communication with the coolant passages in the head.

Figure 8:
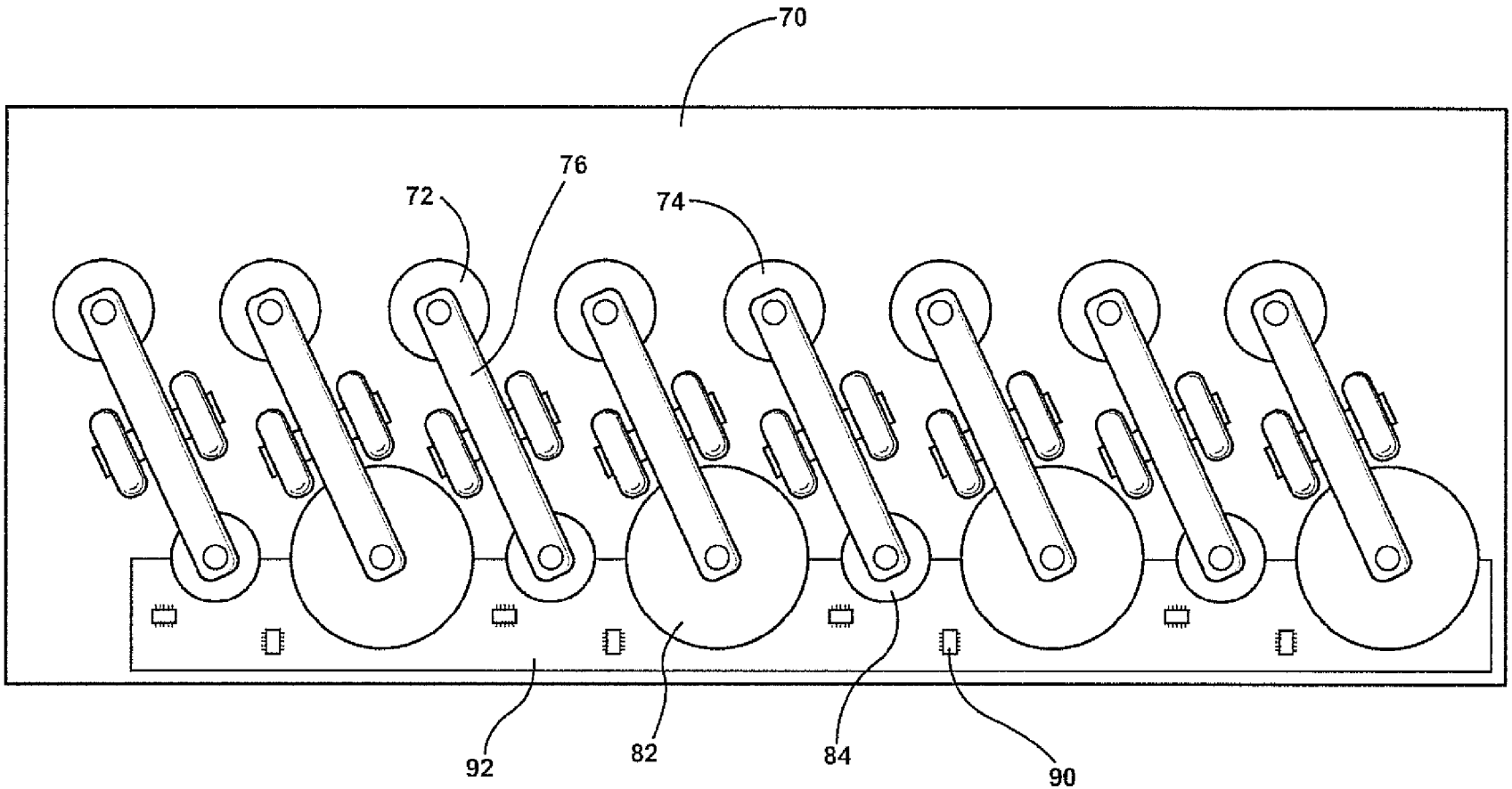
FIG. 8 is a top view of multiple actuation systems according to the present invention.

FIG. 8 schematically illustrates a head 70 with a plurality of valves 72, 74. The valves are illustrated in a row, but may be arranged differently. In this illustration, valve 72 is an exhaust valve and valve 74 is an intake valve. As shown, the actuator 82 for the exhaust valve 72 may be made larger diameter, and therefore more powerful, than the actuator 84 for the intake valve. The reverse is also possible, as is altering the mechanical advantage due to the rocker arms 76. The sizes of the actuators may also be varied where the actuators act directly on valves without intervening rocker arms. FIG. 8 also illustrates a further aspect of the present invention, wherein a circuit board 92 is disposed so as to be in direct connection with the coil wires. Control transistors 90 may be provided thereon. This reduces the length of the leads to the coil wires and improves control.

The present invention also provides for sensing the position of the solenoid piston, and therefore the valve, without the use of additional sensing hardware or auxiliary sensors. As described in Applicant's co-pending application Ser. No. 11/391,733, the entire of contents of which is incorporated herein by reference, the piston position may be sensed using a reactive voltage approach or a current rise time approach. As also described in the incorporated application, the coil may be actuated in a variety of ways including an AC or DC power signal. More preferred is the use of a pulse width modulated (PWM) signal. Any of the other teachings concerning actuator design and/or actuator use described in the incorporated reference may be used in combination with the system described in the present application.

Figure 9:
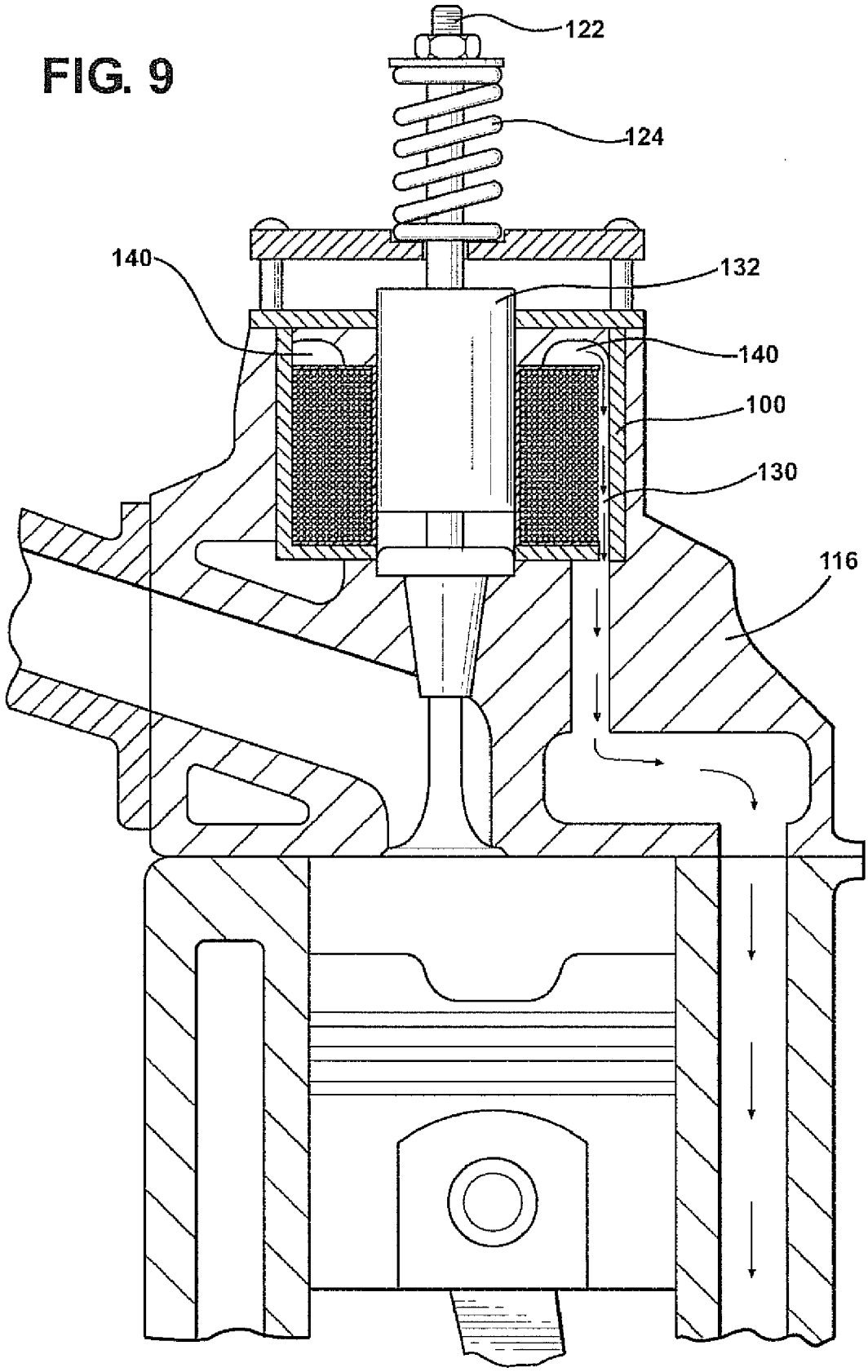
FIG. 9 is a cross sectional view of a portion of an engine illustrating a further alternative embodiment of the present invention.

As known to those of skill in the art, not all engine heads are made of a ferromagnetic material. For example, aluminum heads are common. In some embodiments of the present invention, a coil is used in an aluminum head, or head formed of other non-ferromagnetic material. In order to provide an improved flux path as provided by the cast iron head, a cast iron or other ferromagnetic insert may be provided in the aluminum head in the area around the solenoid coil. FIG. 9 illustrates such an arrangement, wherein the shaded area indicates a portion which may be a ferromagnetic insert 100 within the head 116. As will be clear to those of skill in the art, the ferromagnetic insert may have shapes other than shown. Preferably, the insert has a thickness of at least 0.2 inch above and below the coil 130 and 0.1 inch to the sides. The insert may be multiple pieces, with some pieces added after assembly. Some portions may be cast into the surrounding head.

FIG. 9 also illustrates an alternative actuator arrangement wherein the piston 132 is directly connected to the valve stem 122 and the valve spring 124 is disposed above the piston. As with earlier embodiments, the coil 130 is in fluid communication with the coolant passages 140.

The coils used in the present invention may take a variety of forms, and the wire sizes may be altered. In some embodiments, the coils are made with 125 to 175 turns of 8 to 11 AWG wire. A broader range, such as 100 to 200 turns of 6 to 14 AWG wire may also be used. The use of larger wire provides lower impedance and inductance and therefore faster magnetic charge up, and faster discharge. The use of large diameter wire is typically not desirable, due to cooling considerations, but the liquid cooling provided in the present invention allows improved cooling and the use of the larger diameter wire.

While the Figures illustrate a valve spring that holds the valve closed when the solenoid coil is not active, other arrangements may also be used. For example, the valve spring may be reversed such that the valve spring holds the valve open, with the solenoid coil being active to close the valve. This may be useful in applications where cylinder deactivation occurs, and the valves are left open during cylinder deactivation. As a further alternative, the spring may be reduced in size or eliminated with the valve position being entirely controlled by the actuator. Electronic actuation may be also used in combination with other valve actuation systems, such as in combination with a mechanical valve operating system, a pneumatic or hydraulic valve actuation system, or other systems.

The invention as described herein may also be used in other applications, where opening and closing of valves is required. One example is transmission valve bodies for automatic automotive transmissions. These valve bodies have a plurality of valves which must be opened and closed in order to control the transmission. An arrangement similar to the arrangement in FIG. 1 or 9 may be used with modifications made to fit the application. For example, the valve body itself or portions thereof may be made of a ferromagnetic material to provide a flux path and/or the transmission fluid or other cooling medium may be used to provide direct cooling of the coils.

According to another aspect of the present invention, an ignition coil or coils may be provided in the engine block or head and be arranged such that the ferromagnetic material of the block or head serves as a flux path for the coil and/or the coil may be in fluid communication with the engine coolant. This provides improved cooling and flux path. It is also preferred that the ignition coil is formed with wire that is thicker than typical, such as 8 to 12 AWG on the primary side, thereby providing lower inductance, lower resistance and higher magnetic flux.

While the present invention has been described as using the cooling fluid already present in the cylinder head, the present invention may also be used with a separate cooling system, such as a separate liquid cooling system with its own circulation and heat exchange apparatus.

According to a further aspect of the present invention, the valve actuation profile may be altered to provide a "pulsed" profile. As known to those of skill in the art, valve actuation profiles typically consist of a single opening and closing event for intake or exhaust flow through an intake or exhaust valve. The cam lobe that operates the valve has a ramped surface that gradually opens the valve to a fully open position to provide flow and then slowly ramps to a closed position. Abrupt changes in valve position would cause unacceptably high loads on the cam surface and unacceptably high wear levels. Use of an electromagnetic actuation system as described herein allows different profiles than dictated by a mechanical cam system. For example, the opening and closing rates of the valve are dictated by the force output of the actuation system and the mechanical characteristics of the valve. As such, faster opening and closing speeds may be possible. Also, the timing of the valve actuation, the amount the valve is opened, and other characteristics may be altered depending on a variety of characteristics, including engine speed, operating load, etc. Further, according to one preferred embodiment of the present invention, the intake valve is opened multiple times during the period when a traditional intake valve would be opened a single time. Also, the amount that the valve is opened may be much smaller. According to one approach, the intake valve is opened and closed five times during the intake period with each opening being only approximately 0.1 inch, rather than the typical 0.5 inch. The duration of each of these short opening intervals may be equal to each other and at equal intervals, or may be varied. It is preferred that the timing of the intervals and the interval lengths be chosen so as to take advantage of the inertial characteristics of the incoming airflow. If chosen correctly, the short bursts of intake flow may each occur such that the combustion chamber is packed with additional intake flow. Each pulse of intake will "stack up" in the chamber with the valve being closed before the pulse can return out the intake valve. The valve then reopens as the pulse reflects back again to allow an additional pulse of intake flow. Such a pulsed opening of the intake valve may also be used without reference to the inertial characteristics of the airflow, with the pulsed intake flow providing some benefits with respect to cylinder mixing. This pulsed flow may be used depending on the operating characteristics and conditions of the engine, as will be clear to those of skill in the art.

According, to a further aspect of the present invention, the temperature of the coil may be determined based on the resistance of the coil. This may include using a look up table and/or keeping track of how much the coil has been energized over a given period of time. As the temperature of the coil increases, the resistance will change. This avoids the need for a temperature sensor.

The present invention may make use of linear guide bearings or bushings to guide the piston and/or valve stem and to resist side loads.

For some applications, it is preferable that the coil has a larger outer diameter at the upper end than at the lower end. The valves may be canted to provide additional room at the upper end for this coil shape.

As will be clear to those of skill in the art, the herein described embodiments of the present invention may be altered in various ways without departing from the scope or teaching of the present invention. The following claims, including all equivalents, define the scope of the present invention.

The invention claimed is:

1. A head assembly for an internal combustion engine with an electromagnetic valve actuation system, comprising:

a head having an intake or exhaust passage defined therein, the head is at least partially formed of a ferromagnetic material;

a valve disposed in the passage and operable to selectively open and close the passage;

the head having a cooling passage defined therein for passage of a cooling fluid; and an electromagnetic actuator having a piston in mechanical communication with the valve and a coil in fluid communication with the cooling passage, the coil including a coil support and a coil wire wound around the coil support, the coil of the electromagnetic actuator being disposed in the head such that the coil is at least partially surrounded by the ferromagnetic material such that the ferromagnetic material forms a flux path for the coil, the head assembly being configured such that no ferromagnetic material is disposed between the coil wire and the ferromagnetic material of the head;

wherein the electromagnetic actuator is operable to move the valve between a closed and an open position.

2. The head assembly of claim 1, wherein the coil wire is disposed in direct contact with the cooling fluid from the cooling passage.

3. The head assembly of claim 1, wherein the coil further includes spacers for providing space in the coil wire winding.

4. The head assembly of claim 1, wherein the coil further includes cooling tubes disposed in the coil wire winding.

5. The head assembly of claim 1, wherein the coil wire is a hollow tube.

* * * * *